US006077170A

United States Patent [19]

Hawkins

[11] Patent Number: 6,077,170

[45] Date of Patent: Jun. 20, 2000

[54] GOLF BALL RETRIEVAL ATTACHMENT

[76] Inventor: Roy Hawkins, 5 N. Walnut St., London, Ohio 43140

[21] Appl. No.: 09/098,189

[22] Filed: Jun. 16, 1998

[51] Int. Cl.[7] ..... A63B 57/00

[52] U.S. Cl. ..... 473/286; 294/19.2

[58] Field of Search ..... 473/286; 294/19.2

[56] References Cited

U.S. PATENT DOCUMENTS

| | | | |
|---|---|---|---|
| 2,802,687 | 8/1957 | Du Chene | 294/19.2 |
| 3,058,767 | 10/1962 | Baker | 294/19.2 |
| 3,749,407 | 7/1973 | Prochnow | 473/286 |
| 3,997,169 | 12/1976 | Bergstrom . | |
| 4,687,204 | 8/1987 | Lempio . | |
| 5,112,093 | 5/1992 | Kindling . | |
| 5,188,409 | 2/1993 | Forey . | |
| 5,190,288 | 3/1993 | Rogers . | |
| 5,437,488 | 8/1995 | Richmond et al. . | |
| 5,520,389 | 5/1996 | Furrow . | |
| 5,524,889 | 6/1996 | Rush . | |

*Primary Examiner*—Jeanette Chapman
*Assistant Examiner*—Stephen L. Blau
*Attorney, Agent, or Firm*—Thompson & Thompson, P.A.; Jeffrey L. Thompson

[57] ABSTRACT

A golf ball retrieval attachment includes an elastic sheath having an opening for receiving the head of a golf iron therein, the sheath being removably secured to the head by stretchable attachment thereabout. A semi-rigid elongated tongue is attached to the underside of the sheath and extends parallel to the shaft of the golf iron. The tongue includes a ball retrieval member having a cylindrical bore therethrough. The retrieval member further includes a flexible rim which allows a golf ball to pass thereby into the bore upon minimal pressure by the rim upon the ball. The bore is decreasingly tapered such that a golf ball entering the bore is securely held between the rim and the more narrowly tapered end of the bore. Downward pressure upon the retrieval attachment causes the tongue to bend such that the retrieval member can vertically engage the top of a golf ball. Thus, a golf ball may be retrieved through a lateral scooping motion or by bending the tongue in a vertical cup-like motion. An alternative embodiment having a shorter, inflexible tongue is also disclosed.

9 Claims, 9 Drawing Sheets

GOLF BALL RETRIEVAL ATTACHMENT

BACKGROUND OF THE INVENTION

This invention relates to a golf ball retrieval tool for attachment to a golf iron and, more particularly, to an improved device for retrieving golf balls in various locations about a golf course.

Every golfer, from the beginner to the professional, has experienced the frustration of hitting a golf ball into a location from which the ball must be retrieved before striking it again, e.g. into or near a water hazard, into heavy brush, or onto some other smooth yet unplayable surface. Further, golfers having physical disabilities, such as low back pain, often find difficulty in retrieving their ball even from otherwise accessible places.

Various devices have been proposed in the prior art for retrieving golf balls from difficult to reach locations on a golf course. One such device presents a scoop-like device for retrieving a golf ball. Another device proposes attaching a coiled spring made of spring steel to the head of the golf club. Another device presents a cup-like ball-seizing device integrated into a putter head. Although assumably effective, such known devices are not advantageous for retrieving golf balls from all locations. For example, a scoop attachment may actually knock the ball into a worse position (e.g. the water) if there is no barrier behind the ball to urge the ball into the scoop. Further, it is anticipated that the spring steel attachment will scratch the golf iron to which it is repeatedly attached and detached. Also, the integrated putter head and ball retriever is of limited utility since the putter is often too short to reach the ball or it is not desirable to place the putter in the water. In addition, club head attachments extend away from the club face rather than in a direction parallel to the club shaft, making it difficult to place a protective club cover over the club while the ball retrieval device is attached to the club head. In the present state of the art, therefore, multiple golf ball retrieval tools may be necessary to play a single round of golf.

Thus, it is desirable to have a golf ball retrieval attachment which enables a golfer to retrieve a ball from virtually any location or position, such as a position requiring a sideways or horizontal scooping motion or from a position requiring vertical cup-like securement. It is further desirable to have a ball retrieval attachment which can remain attached to a golf club head without preventing a protective golf cover from being placed over the club head.

SUMMARY OF THE INVENTION

Accordingly, I have invented a golf ball retrieval tool for attachment to a golf iron which utilizes a sheath removably attachable to the head or blade of the golf iron. The sheath, made of a durable, flexibly resilient, elastic material, fits tightly over the head of the golf iron such that it is flexible during use without falling off the head. Attached to the underside of the sheath is a ball retrieval portion having a flexible tongue integrally attached to a ball retrieval member having a cylindrical bore therethrough. The inner wall of the bore includes a flexible rim, having a diameter slightly smaller than a golf ball, which allows passage of a golf ball into the bore upon minimal pressure by a user. The rim then acts to restrict the ball within the housing. The tongue is rigid enough to allow ball retrieval with a sideways or horizontal scooping motion while flexible enough to bend when downward pressure is exerted on the golf club so that the retrieval member can encompass a golf ball lying in a position not conducive to scooping.

It is therefore a general object of this invention to provide a golf ball retrieval attachment for picking up a golf ball which has come to rest in a location where an extended reach is necessary for retrieval.

Another object of this invention is to provide a golf ball retrieval attachment, as aforesaid, which can pick up a golf ball from an otherwise reachable location without a user having to bend at the waist.

Still another object of this invention is to provide a golf ball retrieval attachment, as aforesaid, which can be quickly, easily, and removably secured to the head of a golf iron.

Yet another object of this invention is to provide a golf ball retrieval attachment, as aforesaid, over which a golf club cover can be placed for protecting the golf club and attachment from weather elements.

A further object of this invention is to provide a golf ball retrieval attachment, as aforesaid, which can retrieve golf balls using a sideways scooping motion or by downward club head pressure.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
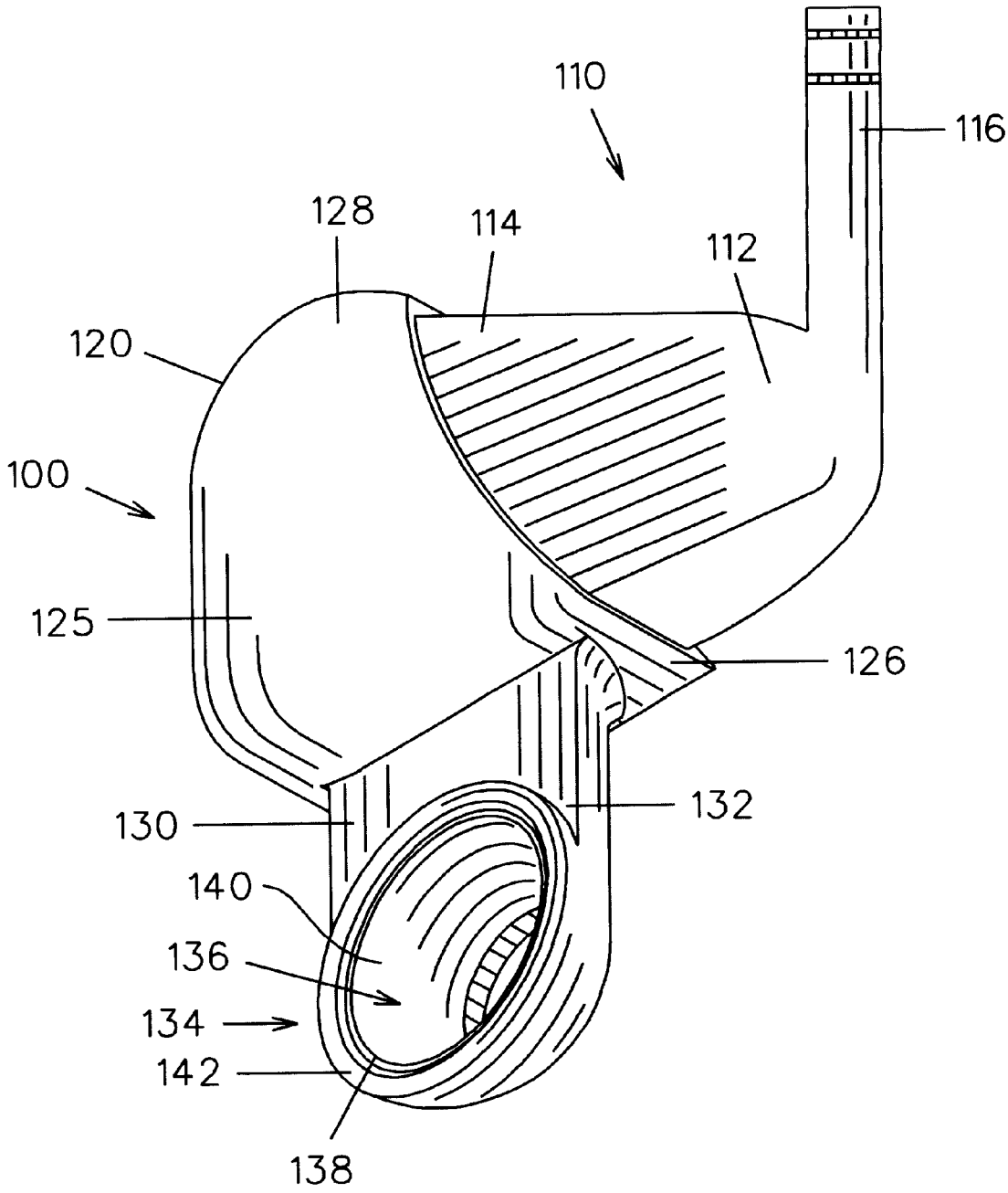
FIG. 1 is a perspective view of the golf ball retrieval attachment attached to the head of a golf iron with the tongue of the attachment in an unbent position.
Figure 5:
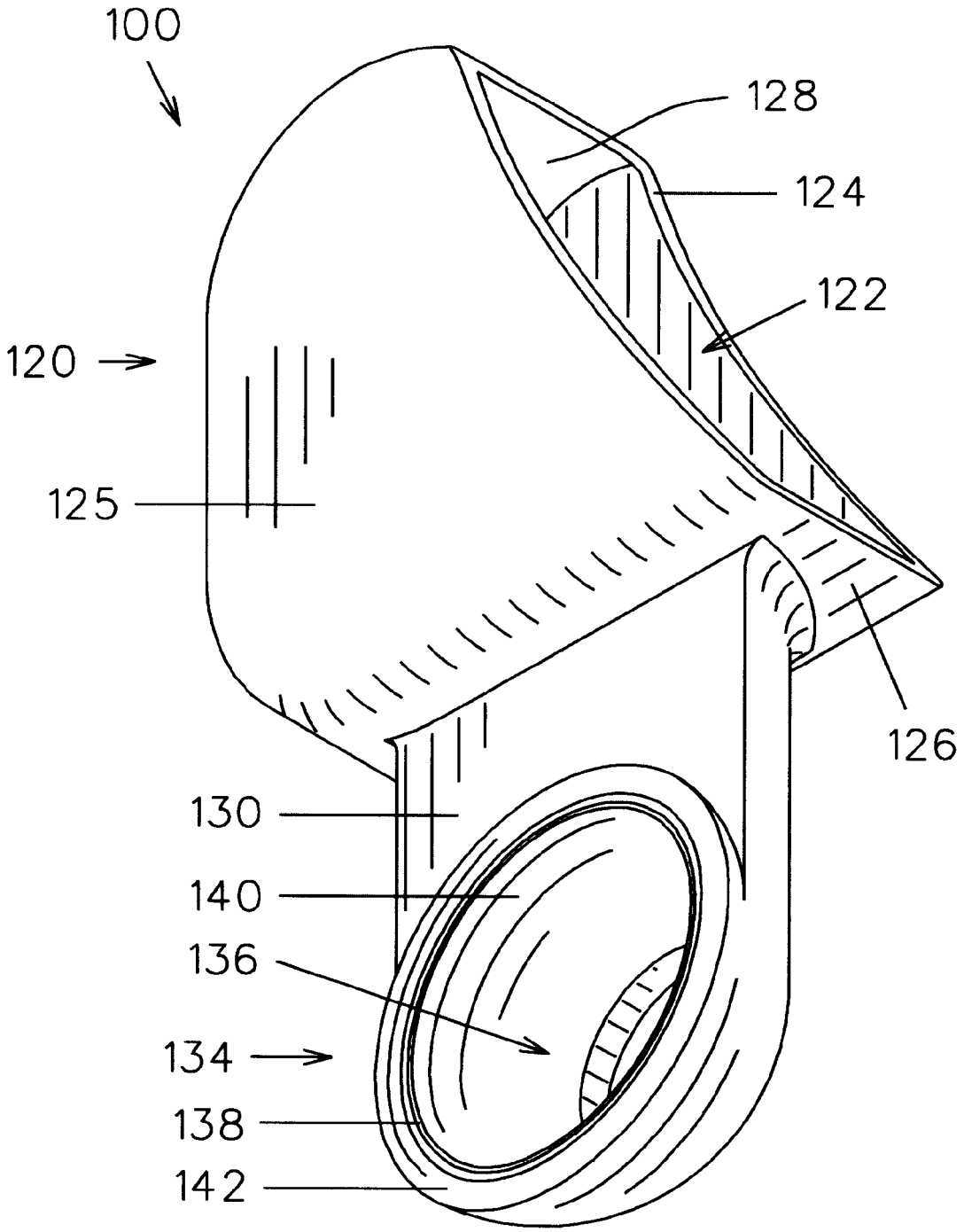
FIG. 5 is a right side perspective view of the attachment of FIG. 3.
Figure 6:
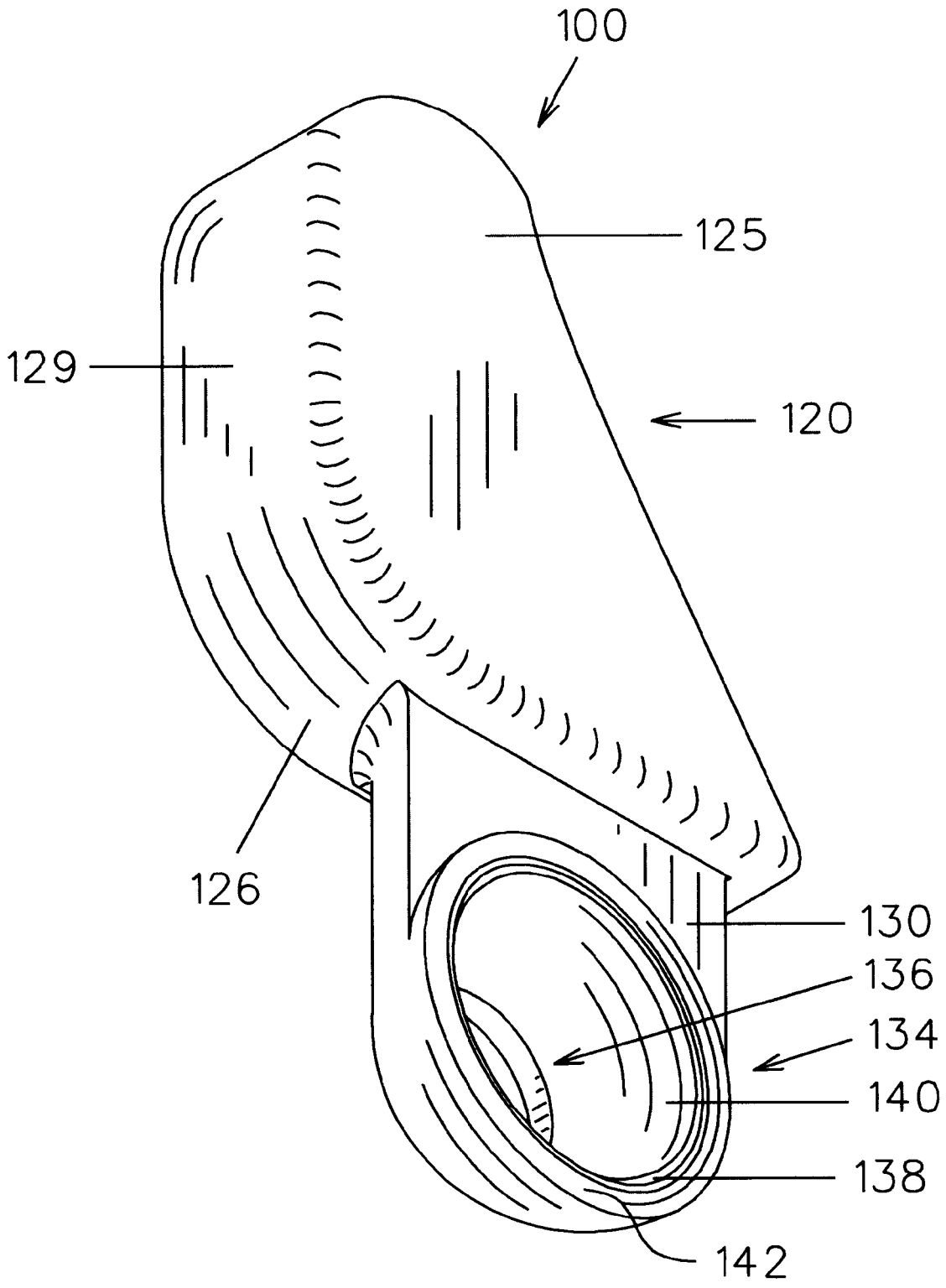
FIG. 6 is a left side perspective view of the attachment of FIG. 3.
Figure 8:
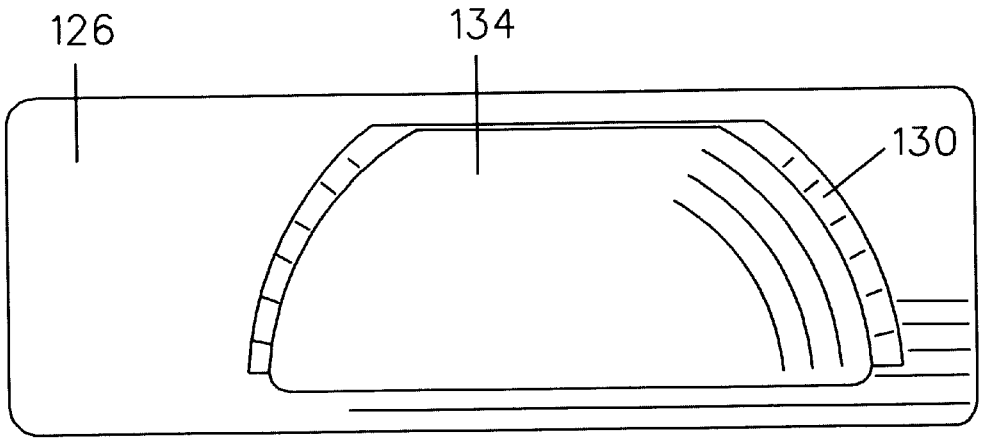
FIG. 8 is a bottom view of the attachment of FIG. 3.
Figure 7:
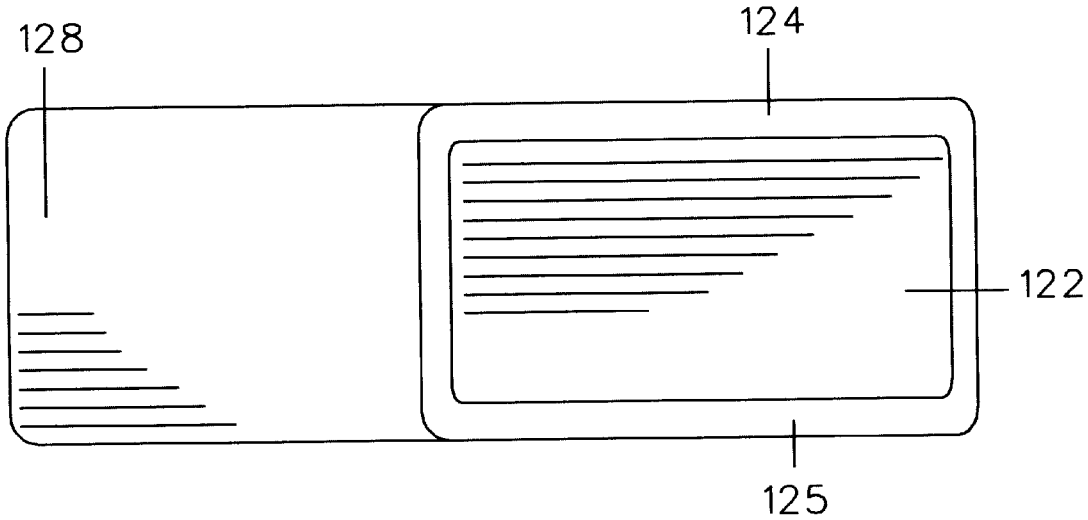
FIG. 7 is a top view of the attachment of FIG. 3.
Figure 9:
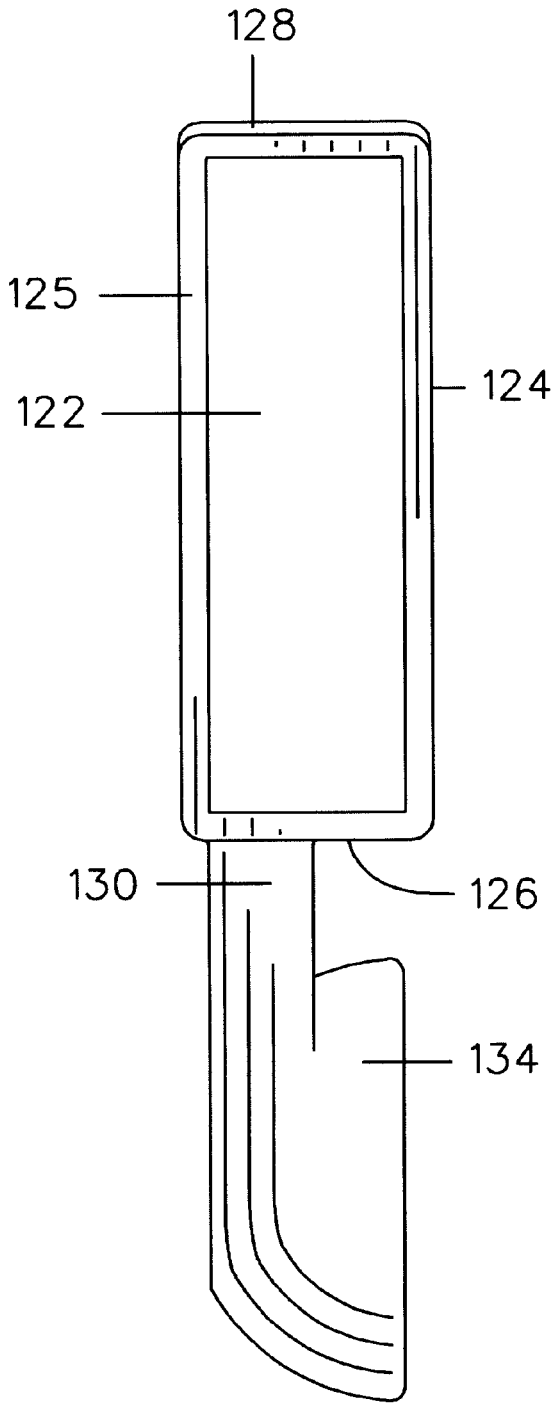
FIG. 9 is a right side view of the attachment of FIG. 3.
Figure 10:
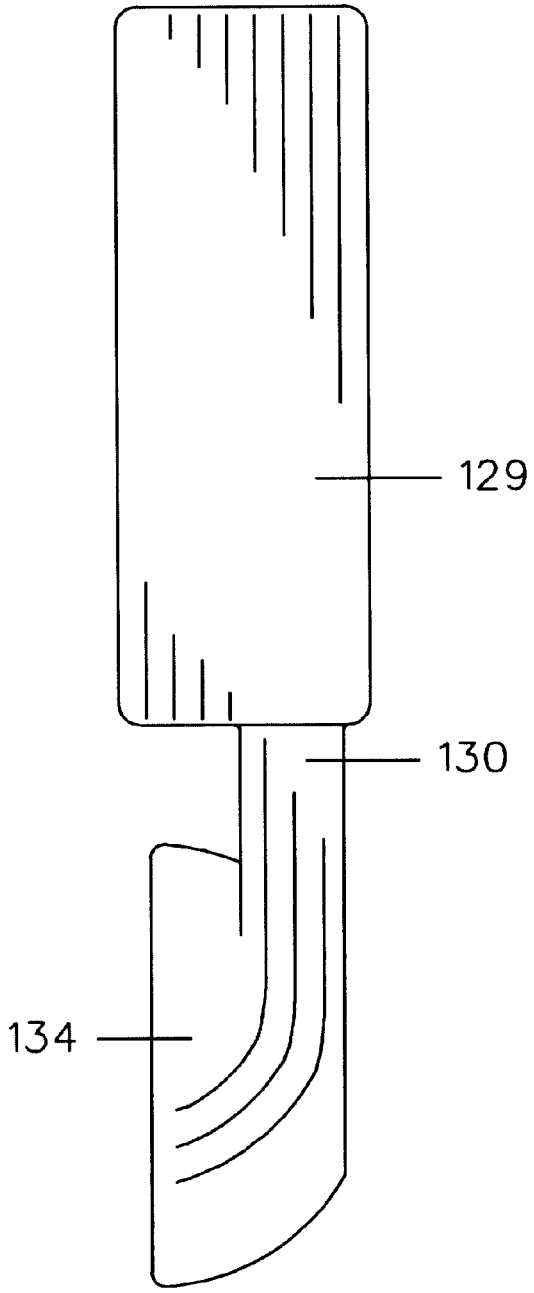
FIG. 10 is a left side view of the attachment of FIG. 3.

Turning more particularly to the drawings, FIG. 1 shows a preferred embodiment of the golf ball retrieval attachment 100 as attached to the head 112 of a golf club iron 110. As seen in FIGS. 1 and 5, the attachment 100 includes a sheath 120, preferably made of a semi-flexible elastomer material, the sheath 120 having a hollow interior opening or cavity 122 into which the head 112 of a golf iron 110 may be slidably inserted.

More particularly, the sheath 120 includes a bottom wall 126 extending substantially the length of the head 112 of the golf iron 110, a top wall 128 for extension over the toe 114 of the golf iron 110, and arcuate right and left side walls 124 and 125 extending therebetween. These walls present an opening 122 into which the head of a golf iron may be inserted into the sheath 120 (FIGS. 5). The sheath further includes a rear wall 129 which extends between side walls 124 and 125 to facilitate proper positioning of the attachment 100 on the golf iron 110.

It is understood that the circumference of the opening 122 is smaller than that of the outer end of the head of a golf iron. Thus, the elastic sheath 120 may be securely and snugly attached over golf iron 110 by first sliding the bottom wall 126 of the sheath 120 onto the club head 112 and then stretching the top wall 128 over the toe 114.

Figure 2:
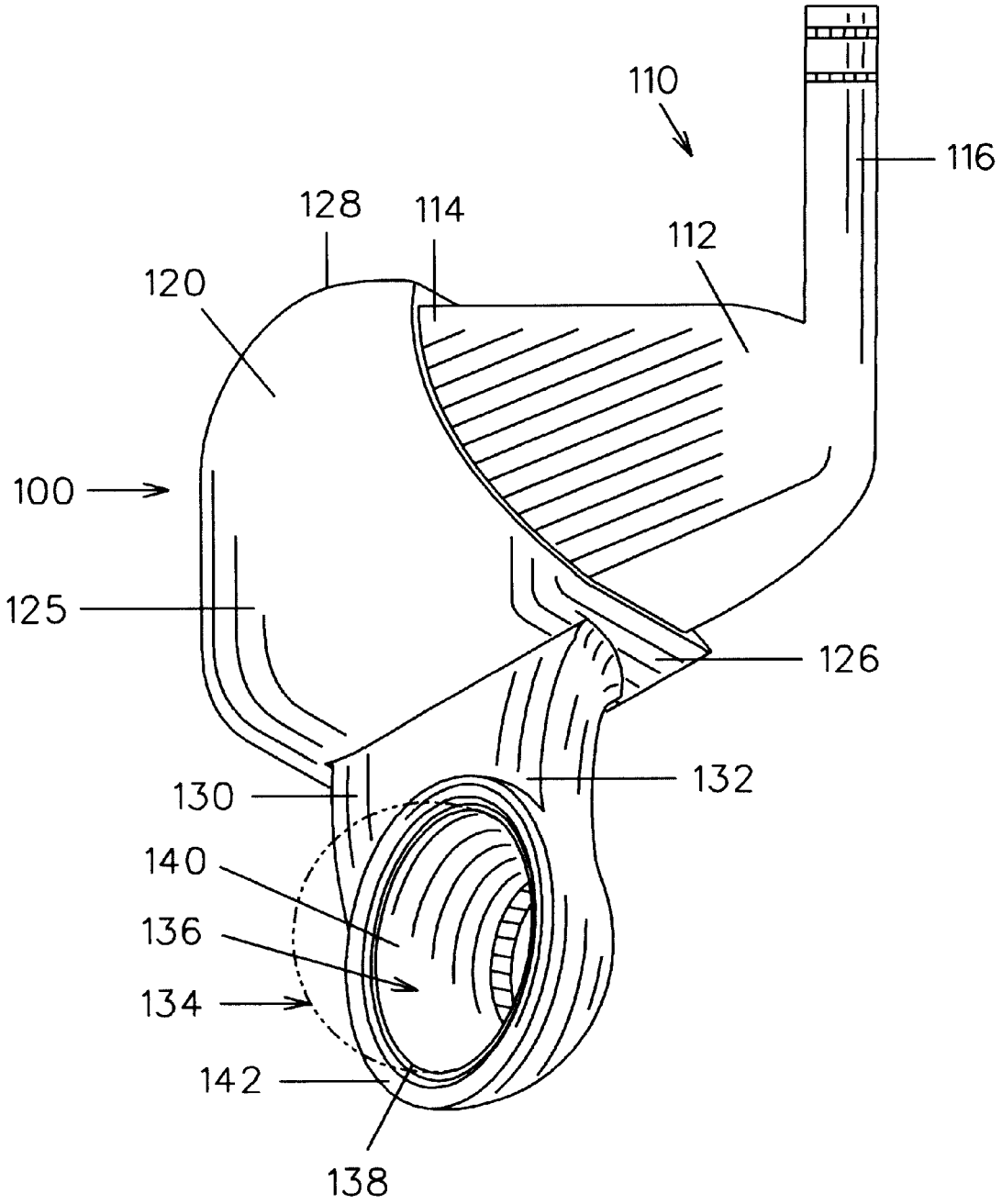
FIG. 2 is a perspective view of the attachment of FIG. 1 with the tongue in a partially bent position, a golf ball being shown in phantom lines by way of example.
Figure 3:
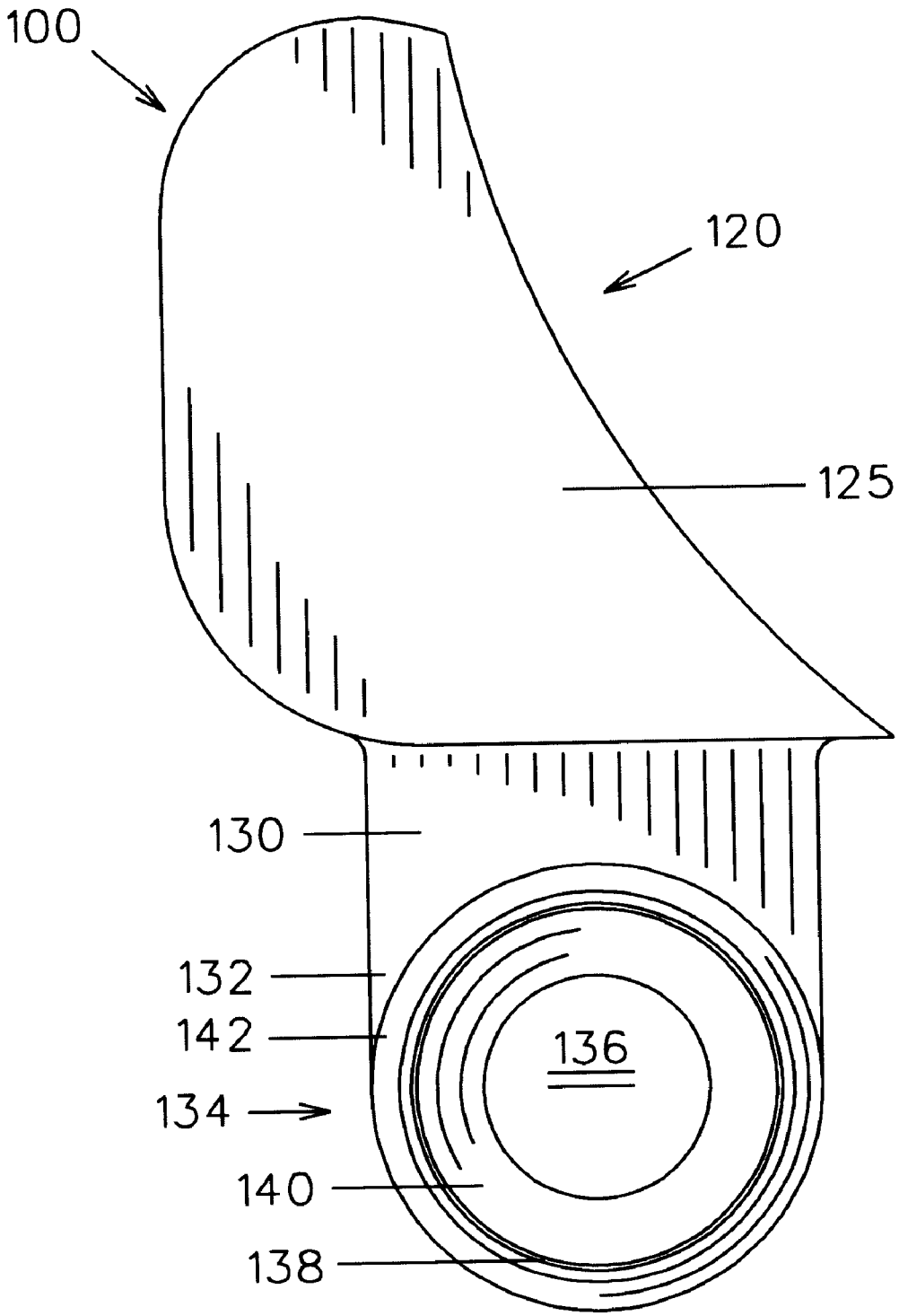
FIG. 3 is a front view of the attachment.
Figure 4:
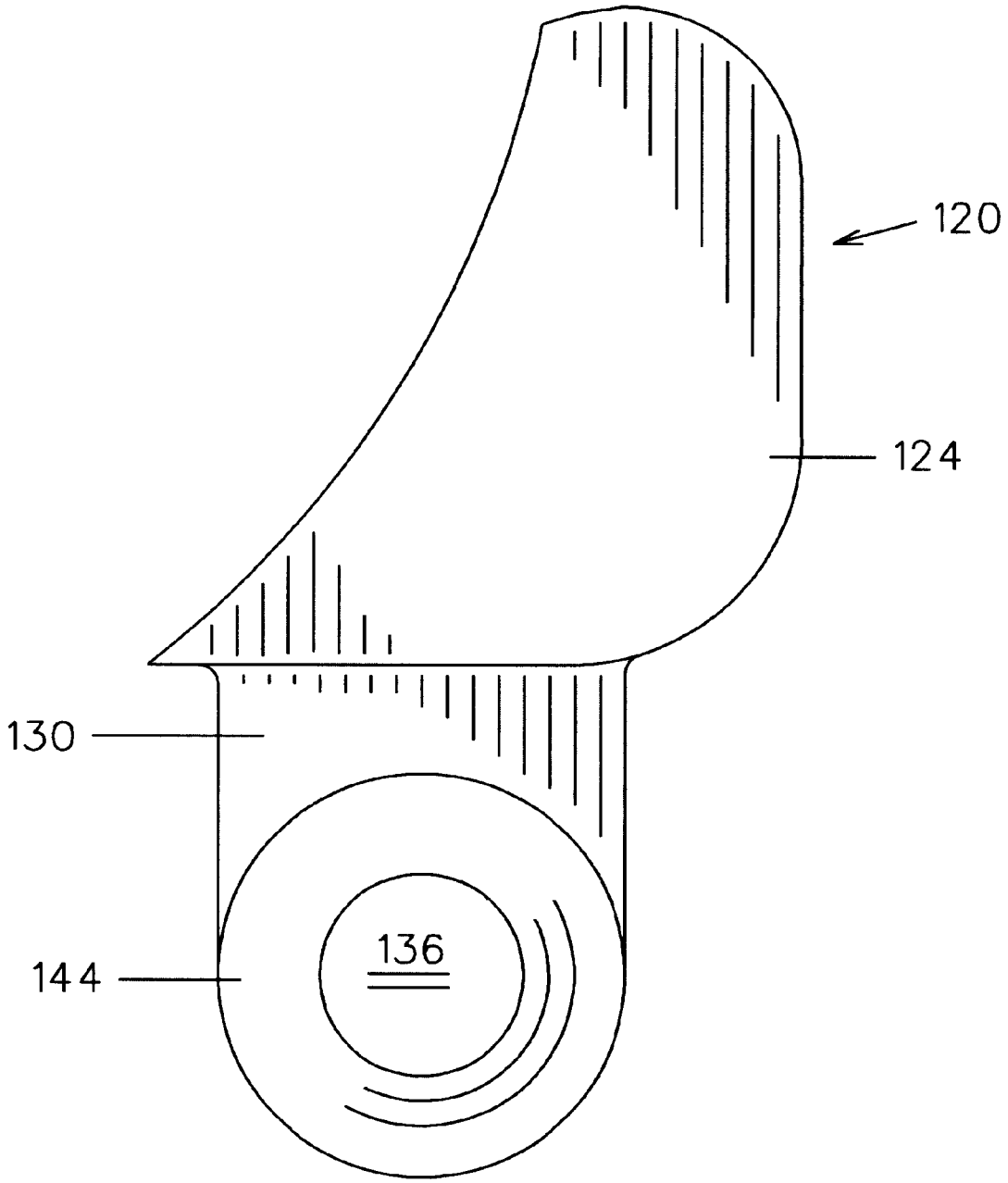
FIG. 4 is a rear view of the attachment of FIG. 3.

As shown in FIGS. 1 and 2, the attachment 100 further includes an elongated tongue 130 integrally attached to the bottom wall 126 of the sheath 120, the tongue 130 being normal to the bottom wall 126 and downwardly extending therefrom. The tongue 130 is preferably made of a semi-rigid material which remains rigid unless downward pressure is exerted upon it as by a user pushing the golf iron toward the ground, this method of retrieving a golf ball to be further described later.

A lower end 132 of the tongue 130 surrounds and is integrally joined to a ball retrieval member 134 having a cylindrical bore 136 therethrough. The retrieval member 134 includes a flexible rim 138 mounted to and extending around the circumference of the inner wall 140 of the bore 136 adjacent a front/inlet end 142 of the retrieval member 134. The rim 138 presents an opening at the front end 142 having a diameter that is slightly less than that of a traditional golf ball such that the rim 138 must be slightly compressed or flexed towards the rear end 144 to allow passage of a golf ball into the bore 136. Once the ball is received within the bore 136, the rim 138 returns to a normal position to secure the ball within bore 136. The bore 136 is decreasingly tapered between front: and rear ends 142, 144 of the retrieval member 134 such that a golf ball may be securely held between the rim 138 and the rear end 144 of the bore 136.

Thus, a golf ball can be urged into the bore 136 of the retrieval member 134 by pressing the flexible rim 138 against the ball. A lateral scooping motion is preferable when a ball is lying against a barrier such that the ball is not pushed away when pressure is exerted thereupon. When such a barrier is not available, it is preferable for a user to exert downward pressure upon the tongue 130 such that the tongue 130 bends, causing the retrieval member 134 to directly engage the top of a ball. Once a ball is urged through the rim 138 and into the bore 136, the ball is securely held between the rim 138 and rear end 144 of the retrieval member 134 (FIG. 2).

Figure 11:
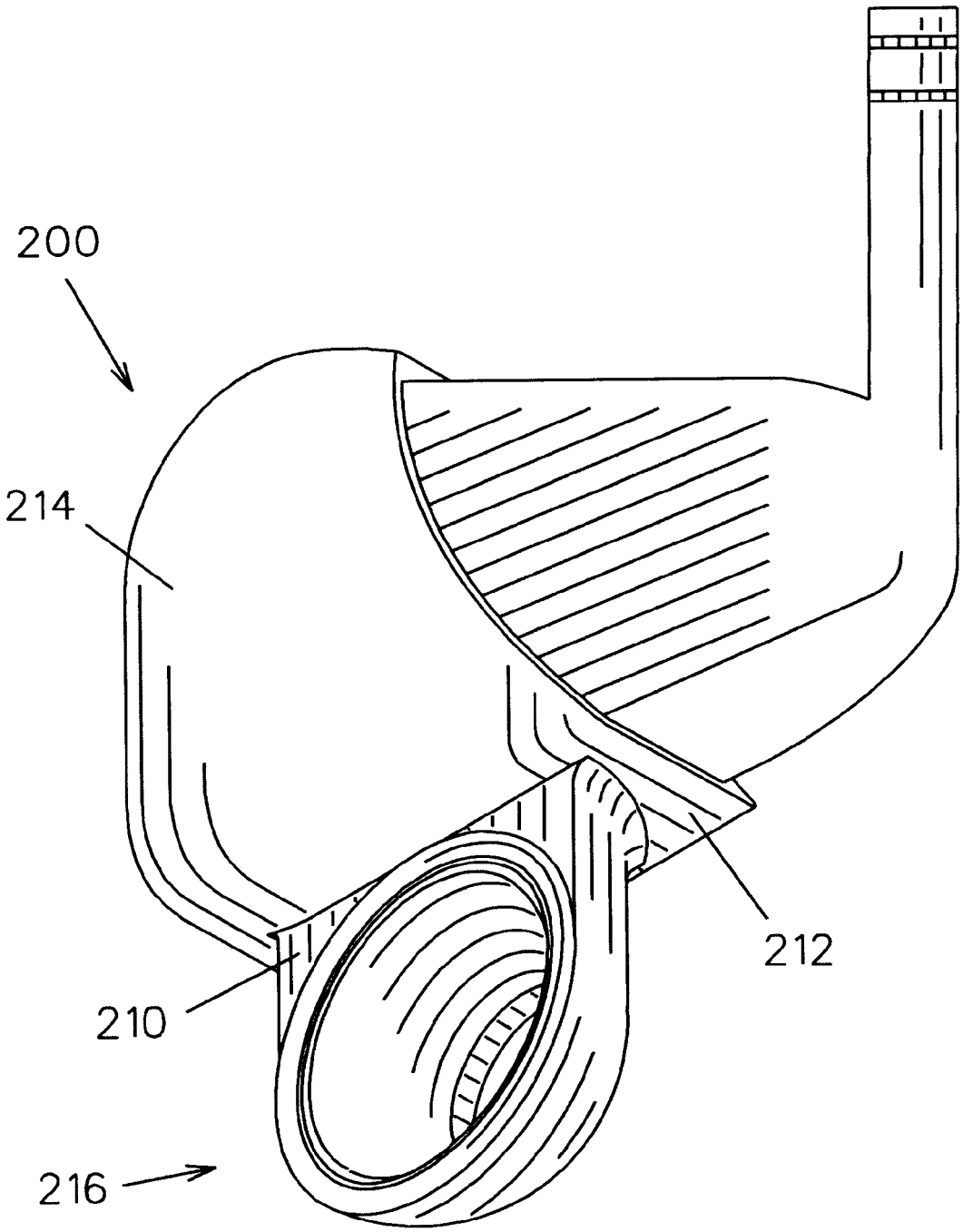
FIG. 11 is a perspective view of an alternative embodiment of the attachment.

Another embodiment 200 (FIG. 11) is very similar to the embodiment described above except that the tongue 210 which depends from the bottom wall 212 of the sheath 214 is of a shorter, truncated construction. More particularly, the tongue 210 is rigid with the ball retrieval member 216 being substantially adjacent the bottom wall 212 of the sheath 214. This embodiment provides a simpler, more cost-effective construction for a golf ball retrieval attachment which still allows a golf club cover to be placed over a golf iron without removing the attachment from the golf iron.

Accordingly, it can be seen that the golf ball retrieval attachment enables a golfer to retrieve a ball from any position reachable with a golf club, whether the preferable retrieval method is a scoop-like or cup-like motion.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A golf ball retrieval attachment, comprising:

a sheath portion presenting a cavity adapted to receive a golf club head and secure said attachment thereto;

a tongue portion integrally attached to and depending from a bottom surface of said sheath portion;

a ball retrieval member at a free end of said tongue, said ball retrieval member having a bore with an open front end sized to receive a golf ball therein and a rim formed around a circumference of said bore, said rim adapted to secure a ball within said bore upon a user placement of said bore about the ball; and said bore extending horizontally through said ball retrieval member and generally perpendicular to said sheath when said sheath is in an upright position and being tapered from said front end to a rear end with said rim being adjacent said front end to hold the ball between said rim and said rear end of said bore, a diameter of said rim being slightly less than the ball's diameter.

2. A golf ball retrieval attachment as claimed in claim 1 wherein said sheath includes arcuate side edges for enhancing insertion of the golf club into said cavity.

3. A golf ball retrieval attachment as claimed in claim 1 wherein said cavity has a circumference smaller than a circumference of the golf club head to provide a snug fit of said sheath over the golf club head.

4. A golf ball retrieval attachment as claimed in claim 1 wherein said sheath is resilient.

5. A golf ball retrieval attachment as claimed in claim 1 wherein said rim is made of a flexible material.

6. A golf ball retrieval attachment as claimed in claim 1 wherein said rim is made of a compressible material.

7. A golf ball retrieval attachment, comprising:

a flexibly resilient sheath presenting a cavity adapted to receive a golf club head and secure said attachment thereto;

a tongue portion integrally attached to and depending from a bottom surface of said sheath;

a ball retrieval portion fixedly attached to a free end of said tongue and extending therefrom from a bottom surface thereof and presenting a bore therethrough sized for passage of a golf ball and adapted to secure the ball therein upon placement of said bore about the ball;

said ball retrieval portion having a rim extending around a circumference thereof, said rim securing the ball within said bore upon passage of the ball into said bore; and said bore extending horizontally through said ball retrieval member and generally perpendicular to said sheath when said sheath is in an upright position and being tapered from said front end to a rear end with said rim being adjacent said front end to hold the ball between said rim and said rear end of said bore, a diameter of said rim being slightly less than the ball's diameter.

8. A golf ball retrieval attachment as claimed in claim 7 wherein said rim is made of a compressible material, a compression of said material allowing for passage of the ball through said rim and into said bore.

9. A golf ball retrieval attachment as claimed in claim 7 wherein said rim is made of a flexible material, a flexion of said material allowing for passage of the ball through said rim and into said bore.

* * * * *